US008966916B2

(12) United States Patent
Deaconu

(10) Patent No.: US 8,966,916 B2
(45) Date of Patent: Mar. 3, 2015

(54) EXTENDED RANGE HEAT PUMP

(75) Inventor: Stelu S. Deaconu, Gaithersburg, MD (US)

(73) Assignee: Streamline Automation, LLC, Huntsville, AL (US)

( * ) Notice: Subject to any disclaimer, the term of this patent is extended or adjusted under 35 U.S.C. 154(b) by 364 days.

(21) Appl. No.: 13/417,225

(22) Filed: Mar. 10, 2012

(65) Prior Publication Data

US 2012/0227426 A1 Sep. 13, 2012

Related U.S. Application Data

(60) Provisional application No. 61/451,387, filed on Mar. 10, 2011.

(51) Int. Cl.

| | |
|---|---|
| ***F25B 1/00*** | (2006.01) |
| ***F25B 1/10*** | (2006.01) |
| *F25B 39/02* | (2006.01) |
| *F25B 41/04* | (2006.01) |

(52) U.S. Cl.

CPC ..... *F25B 1/10* (2013.01); *F25B 39/028* (2013.01); *F25B 41/043* (2013.01); *F25B 2341/066* (2013.01); *F25B 2400/0411* (2013.01); *F25B 2400/072* (2013.01); *F25B 2400/13* (2013.01); *F25B 2400/23* (2013.01); *F25B 2600/026* (2013.01)

USPC ..... 62/115; 62/324.1

(58) Field of Classification Search

USPC ..... 62/115, 126, 324.1, 324.6, 335, 510, 62/513

See application file for complete search history.

(56) References Cited

U.S. PATENT DOCUMENTS

| | | | | |
|---|---|---|---|---|
| 3,719,057 | A * | 3/1973 | Grant | 62/193 |
| 4,947,655 | A * | 8/1990 | Shaw | 62/200 |
| 5,927,088 | A | 7/1999 | Shaw | |
| 6,343,486 | B1 * | 2/2002 | Mizukami | 62/509 |
| 7,356,998 | B2 * | 4/2008 | Lee et al. | 62/160 |
| 7,849,700 | B2 * | 12/2010 | Seefeldt | 62/185 |
| 2006/0174639 | A1 * | 8/2006 | Lee et al. | 62/160 |

FOREIGN PATENT DOCUMENTS

EP 2 088 388 A1 8/2008

OTHER PUBLICATIONS

Bertsch, S.S., Groll, E.A. (2008) Int. J. of Refrigeration 31:1282-1292.
Heo, J., Jeong, M. W., and Kim, Y. (2010a) Int. J. of Refrigeration 33:848-855.
Heo, J., Jeong, M. W., Baek, C., and Kim, Y. (2010b) Int. J. of Refrigeration 34(2):444-453.
Kim, B.H. (2001) Korean Journal of Air-Conditioning and Refrigeration 13:746-756.
Wang, X., Hwang, Y., and Radermacher, R. (2009) Int. J. of Refrigeration 32:1442-1451.

* cited by examiner

*Primary Examiner* — Melvin Jones
(74) *Attorney, Agent, or Firm* — KIPA AB; Tomas Friend

(57) ABSTRACT

A two-stage air source heat pump having an extended operational temperature range combines intercooling, regeneration, and inter-stage vapor recirculation. Cooling a working gas in between the lower and higher-pressure stages decreases the work required to compress the working gas. The entire system may be computer controlled using sensors to monitor flows, temperatures, and pressures in and around the system.

13 Claims, 7 Drawing Sheets

EXTENDED RANGE HEAT PUMP

CROSS-REFERENCE TO RELATED APPLICATIONS

This application is a non-provisional of and claims priority under 35 U.S.C. 119(e) to U.S. 61/451,387 filed 10 Mar. 2011, which is incorporated by reference in its entirety.

STATEMENT REGARDING FEDERALLY SPONSORED RESEARCH

Not Applicable.

BACKGROUND OF THE INVENTION

1. Field of the Invention

In the United States, Residential space heating consumes 82 billion kWh of electricity, 2,870 billion cubic feet of natural gas, 5,251 million gallons of fuel oil, 127 million gallons of kerosene, and 3,521 millions gallons of LPG annually. Commercially, building heating accounts for 1.04 trillion kWh electricity, 615 billion kWh natural gas, and 67 billion kWh of fuel oil. 70% of the energy produced in the US last year was obtained from combustion of fossil fuels (coal, natural gas, and oil) and each kWh used requires 3 kWh in fossil fuel energy at the generator. Any improvement in the efficiency and reliability of installed heating systems, even in small percentages, has a significant impact on energy consumption and emissions of greenhouse gasses.

Heat pumps play an important role in achieving energy savings in heating and cooling. A heat pump is a relatively simple thermodynamic system whose purpose is to transport heat from a colder environment (e.g. from the outdoors) to a warmer environment (the indoor space). When used in reverse, the same system becomes an air conditioner, which transfers of from the cooler indoor space to the warmer outdoor environment. To achieve this transport of heat, the heat pump uses electricity or mechanical work to drive a thermodynamic cycle, comprising a working gas (refrigerant), a compressor 1, a condenser 2, an expansion valve 3 and an evaporator 4 as seen in FIG. 1. Arrows in the figure indicate the direction of flow of the working gas.

2. Description of Related Art

The performance of an air source heat pump degrades when it operates at either very low or very high temperatures. This performance degradation is due to an increase in irreversibilities during the refrigerant compression process, a reduction in the refrigerant mass flow, and a deterioration of the heat transfer capacity in the heat exchangers. If most of the high end, commercially available heat pump systems achieve coefficients of performance (COP) as high as 4-6 (i.e. for each kW of work input, 4-6 kW of heat is transferred to the heated space) when operating at nominal ambient conditions of 45-47° F. or above, their coefficient of performance drops to 1.5-1.8 at 15° F. To supplement the loss of efficiency and of heating capacity at low ambient (cold source) temperatures, most of these systems are equipped with electrical or gas fired heaters/furnaces. Currently there are no heat pumps systems offered commercially that operate efficiently at temperatures lower than 15° F.

Air source heat pumps have the possibility to operate beyond their nominal ranges while preserving cycle efficiency by modifying their system configurations (Kim (2001), Bertsch and Groll (2008), Wang et al. (2009), and Heo et al. (2010a)). The merits of several modified refrigeration cycles are summarized by Heo et al. (2010b). FIG. 2A-D shows schematic diagrams of systems used in four methods for improving the efficiency of vapor compression refrigeration cycles. FIG. 2A shows a Flash-Tank Vapor Injection (FTVI) system; FIG. 2B shows a Flash-Tank and Sub-Cooler Vapor Injection (FTSC) system; FIG. 2C shows a Sub-cooler Vapor Injection (SCVI) system; and FIG. 2D shows a Double Expansion Sub-cooler Vapor Injection (DESC) system. All of the systems comprise a compressor 1, a condenser 2, expansion valves 3, and an evaporator 4. The FTVI system additionally comprises a flash tank located between the condenser 2 and evaporator 4 and an injection valve 6 controlling flow of working gas from the flash tank 5 to the compressor 1. The FTSC system, like the FTVI system, additionally comprises a flash tank located between the condenser 2 and evaporator 4 but also includes a subcooler 7 between the flash tank 5 and the evaporator 4 and between the flash tank 5 and the compressor 1. The SCVI and DESC systems comprise a receiver 8 and a subcooler 7 in series between the condenser 2 and evaporator 4 and an injection valve 6 controlling flow of working gas from the flash tank 5 to the compressor 1.

These cycles improve the efficiency of a regular vapor compression cycle by increasing the amount of heat transfer at constant temperature (in the two phase and liquid state) and reducing the amount of work required to compress the refrigerant vapor between the two isobars of the cycle. The difference between the regular vapor compression cycles (dashed line) and vapor-injected cycles (grey line) corresponding to the systems shown in FIG. 2A-D are shown in the pressure—enthalpy diagrams in FIG. 3 A-D. The performance of each cycle is directly proportional to the area enclosed by the cycle under the saturation curve (curved black line).

The modifications to existing heat pumps suggested by the above-referenced articles suffer from several drawbacks. For example, there is insufficient heat output as the required heat increases whereas the heat pump capacity decreases mainly due to lower refrigerant mass flow rates delivered by the compressor at high pressure ratios. High compressor discharge temperature is caused by low suction pressure and high pressure ratio across the compressor. COP decreases rapidly for the high pressure ratios necessary for heating at low ambient temperature conditions. Heat pumps designed for low ambient temperature conditions usually have capacities that are too large at medium ambient temperatures. This requires cycling of the heat pump on and off at higher ambient temperatures in order to reduce the heating capacity. Transient effects associated with cycling leads to a lower efficiency relative to steady-state operation. The FTVI cycle may experience flooding in the compressor at high speeds due to the difficulty of accurately controlling the amount of vapor injection.

BRIEF SUMMARY OF THE INVENTION

The present invention overcomes the aforementioned limitations of prior art heat pumps by providing a two-stage compression air source heat pump system and a regenerated inter-stage vapor recirculation cycle and a method for operating the heat pump.

DETAILED DESCRIPTION OF THE INVENTION

Figure 1:
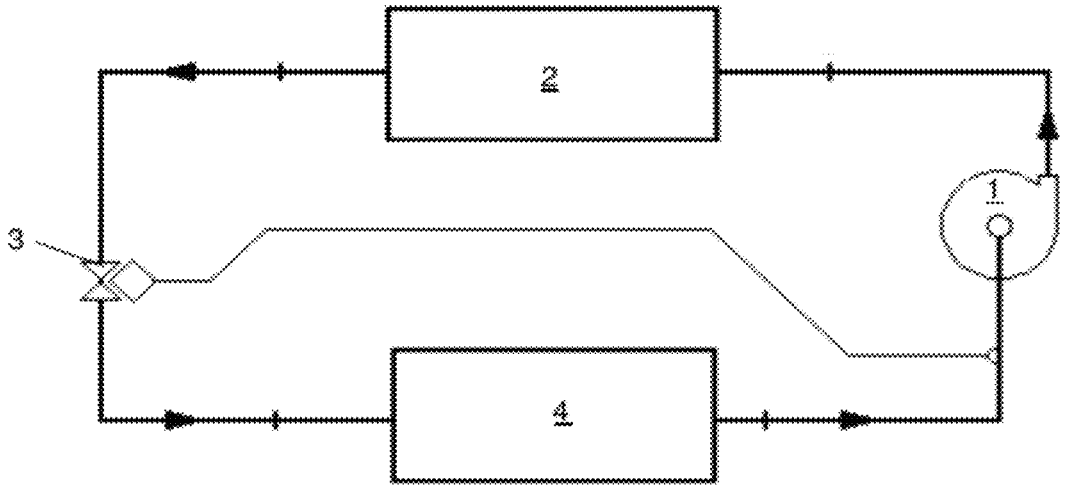
FIG. 1 (Prior Art)
FIG. 1 is a schematic diagram showing the basic components of a typical prior art heat pump system.
Figure 2:
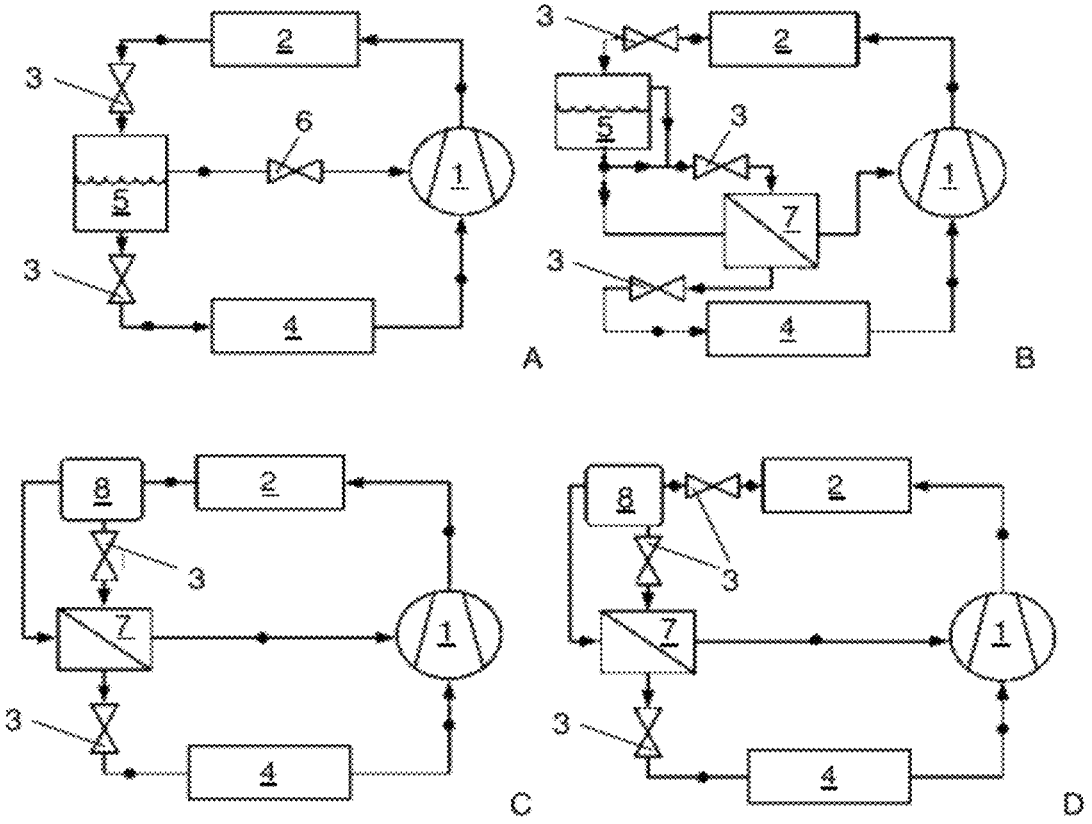
FIG. 2 (Prior Art)
FIG. 2A-D shows schematic diagrams of four prior art systems design to improve the efficiency of prior art heat pump systems.
Figure 3:
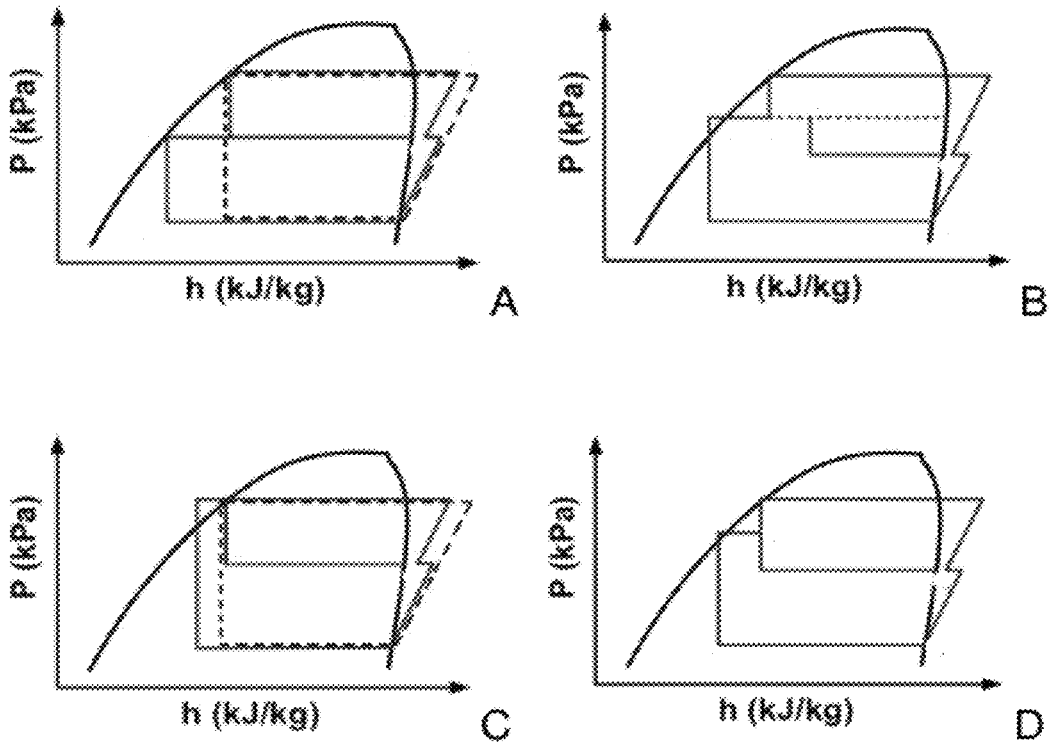
FIG. 3 (prior art)
FIG. 3A-D shows pressure-enthalpy diagrams for the heat pump systems shown in FIG. 2A-D.

Specific embodiments of the invention are described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

This description focuses on embodiments of the present invention applicable to heating and in particular to using a two-stage, extended range, air source heat pump for heating an indoor space at low and very low ambient temperatures. However, it will be appreciated that the invention is not limited to this application but may be used for the transfer of heat for many other purposes including cooling as well as heating applications and that the invention is also applicable to water and ground source heat pumps, for example.

The present invention may be embodied as a device, a system, a method or combinations of these with or without a computer program product. Accordingly, the present invention may take the form of an entirely hardware embodiment, a software embodiment or an embodiment combining software and hardware aspects all generally referred to herein as a "circuit" or "module." Furthermore, the present invention may take the form of a computer program product on a computer-usable storage medium having computer-usable program code embodied in the medium. Any suitable computer readable medium may be utilized including hard disks, CD-ROMs, optical storage devices, a transmission media such as those supporting the Internet or an intranet, or magnetic storage devices.

The presently described Extended Range Heat Pump (XRHP) is a two-stage air source heat pump with intercooling, regeneration, and inter-stage vapor recirculation that provides improved efficiency relative to existing heat pumps when operating at an expanded range of cold source temperatures, while mitigating disadvantages of vapor-injected cycles. Performing the compression process in stages and cooling a working gas in between the lower and higher-pressure stages decreases the work required to compress the gas between two specified pressures. The two-compressor heat pump lends itself directly to improving the energetic efficiency by intercooling with regeneration and inter-stage vapor recirculation, also known as vapor injection for single stage systems. Additional control and performance enhancements may be achieved by employing inverter-driven compressors, electronic expansion valves and or thermal expansion valves. The entire system may be computer controlled and operation of the system may be controlled using software designed to accept input from sensors in the heat pump and send instructions to control modules connected to compressors, valves, and other controllable system components.

Figure 4:
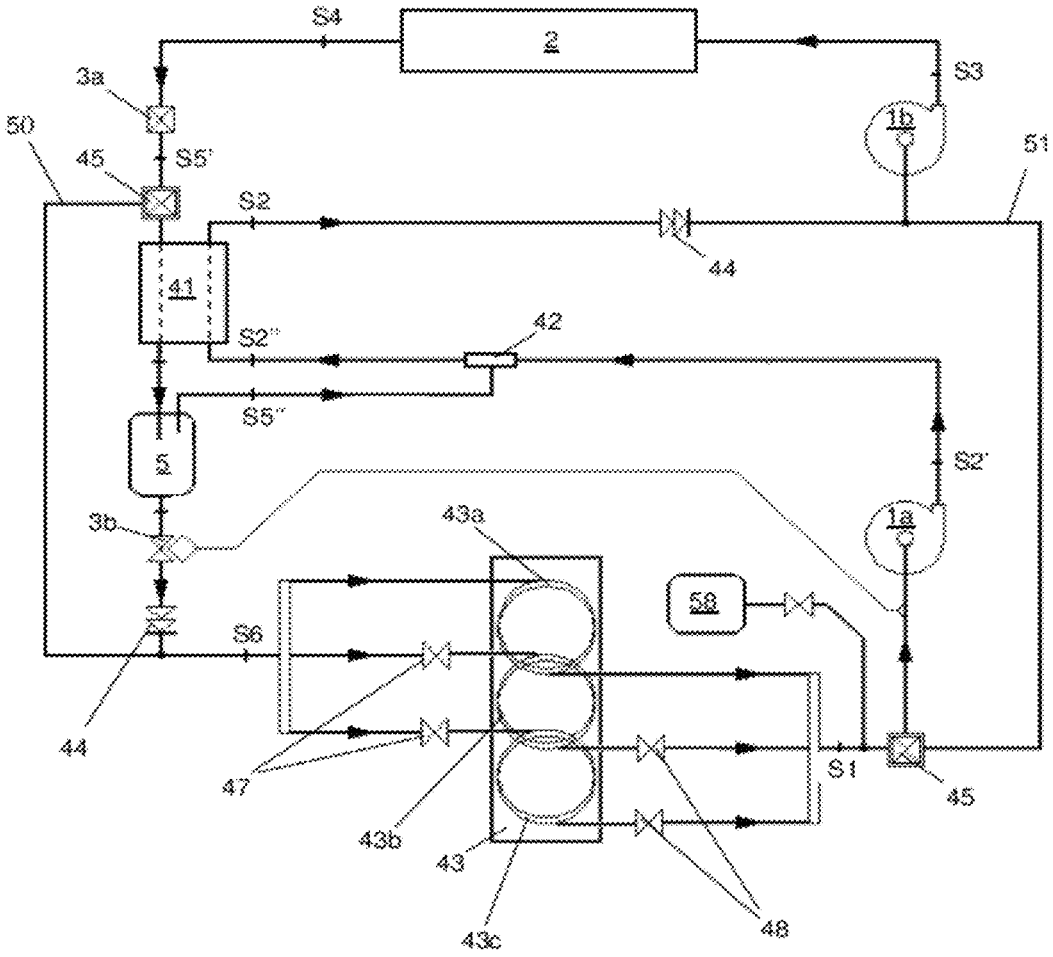
FIG. 4 is a diagram showing a first embodiment of an extended range heat pump according to the present invention.

FIG. 4 shows the main components of a first embodiment of the thermodynamic cycle of the XRHP system. Reference elements s1, s2', s2, s3, s4. s5', s$\mathbf{5}_g$", s$\mathbf{5}_f$" and s6 refer to states of the working gas at different positions in the operational cycle. Arrows indicate the direction of movement of the working gas/fluid through the system. The system exploits the advantages of inter-stage vapor recirculation and improves efficiency by regenerating extra refrigerant heat (superheat) after the first compressor stage. One improvement results from positioning an intercooler 41, at the intermediate system pressure, before flash phase separation in a flash tank 5. This addition of enthalpy to the refrigerant stream exiting the high pressure stage expansion valve 3*b* increases the quality of the two-phase mixture in a manner inversely proportional to the compression efficiency of the first-stage compressor 1*a*. As the efficiency of the compression by lower stage compressor 1*a* decreases, more heat is recovered and the quality of the mixture in the flash-tank improves. This mechanism provides the cycle with means of self-compensation for a reduction in lower stage compressor efficiency. The vapor extracted from the phase separating flash tank 5 is mixed in a mixing manifold 42 with the output of the lower stage compressor 1*a* prior to passing through the intercooler 41. This ensures that the vapor reaching the high pressure stage compressor 1*b* is slightly superheated and prevents liquid refrigerant from entering the compressor 1*b*. To maintain required heat capacity at low temperatures, a multi-coil evaporator 43 is used to control the amount of refrigerant passing thorough evaporator coils 43*a-c*, thereby ensuring that the necessary evaporator heat transfer takes place regardless of evaporator pressure.

Example

Operation at a Low Ambient Temperature

When operating at a low temperature, e.g. 245K/−18° F., the refrigerant routing valves 45 direct the refrigerant through the flash-tank circuit, and the high stage compressor 1*b* and electronic expansion valve 3*a* are operated so as to maintain a constant condenser pressure of 2.32 MPa and a flash-tank pressure of 0.76 MPa for a constant upper stage compression ratio of 3.05:1. All evaporator coils 43*a-c* are active to provide the necessary volume for refrigerant expansion to the lower system pressure of 0.24 MPa.

Figure 5:
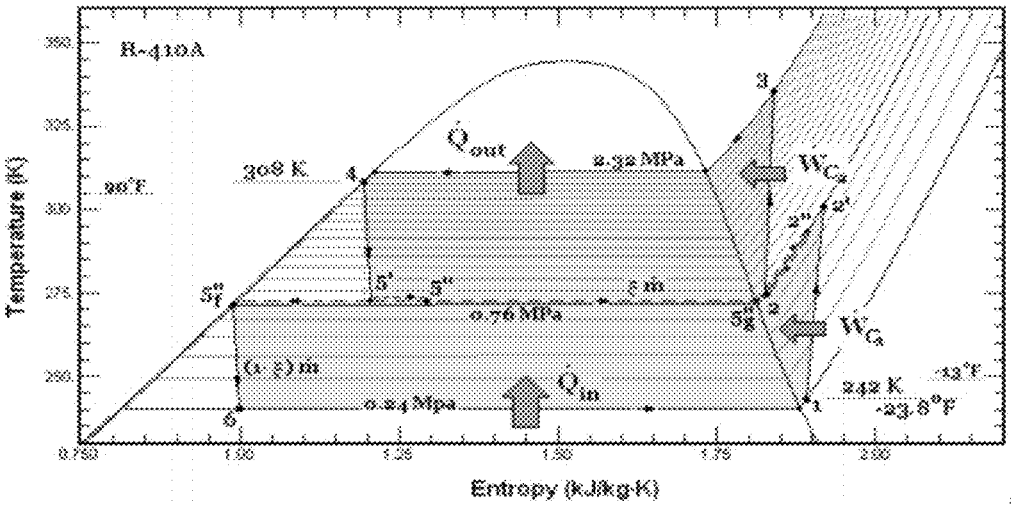
FIGS. 5A and B shows pressure-entropy diagrams for the system shown in FIG. 4 operating at an ambient temperature of 245K and 260K.
Figure 5:
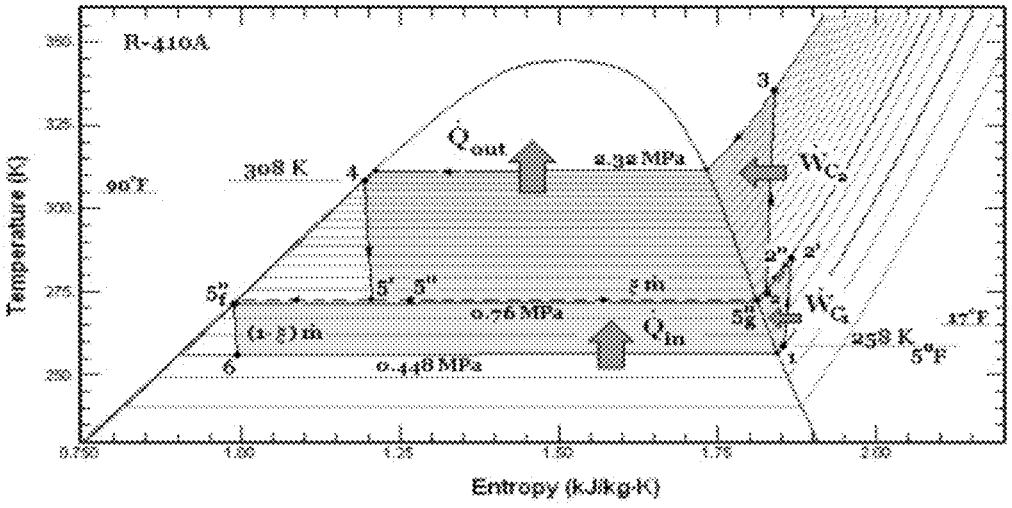

The thermodynamic cycle of the pump on a temperature—entropy diagram is shown in FIG. 5A. Thermodynamic parameters at each state are listed in Table 1.

TABLE 1

| | State | | | | | | | |
|---|---|---|---|---|---|---|---|---|
| | 1 | 2' | 2 | 3 | 4 | 5' | 5" | 6 |
| T(K) | 242 | 300 | 273 | 336 | 308 | 271 | 271 | 240 |
| p(MPa) | 0.24 | 0.76 | 0.76 | 2.32 | 2.32 | 0.76 | 0.76 | 0.24 |

TABLE 1-continued

| | State | | | | | | | |
|---|---|---|---|---|---|---|---|---|
| | 1 | 2' | 2 | 3 | 4 | 5' | 5" | 6 |
| ρ(kJ/kg) | 9.358 | 24.642 | 28.821 | 77.536 | 1008.5 | 102.71 | 80.905 | 51.422 |
| h(kJ/kg) | 409.94 | 449.79 | 422.37 | 460.85 | 256.77 | 256.77 | 274.26 | 197.7 |
| S(kJ/kg × K) | 1.888 | 1.915 | 1.819 | 1.842 | 1.191 | 1.209 | 1.274 | 1.005 |
| ξ | 1 | 1 | 1 | 1 | 0 | 0.265 | 0.343 | 0.174 |

The COP of the heat pump operating between 2.32 MPa (336.5 psi), 305K (90° F.) hot reservoir/sink and 0.24 MPa (34.8 psi), 245K (−18.4° F.) cold reservoir/source, allowing for condenser and evaporator heat transfer inefficiencies, following a thermodynamic cycle comprising states 1-2'-2-3-4-5'-6 as shown in FIG. 5A, is:

$$COP=Q_{out}/(W_{C1}+W_{C2})=(h_3-h_4)/((1-\xi_{5''})\cdot(h_2-h_1)+h_3-h_2)=3.16$$

constant condenser pressure of 2.32 MPa and a flash-tank pressure of 0.76 MPa for a constant upper stage compression ratio of 3.05:1. Valves V1b and V2b close, taking their evaporator coils out of the circuit and reducing the volume for refrigerant expansion to a low system pressure of 0.448 MPa. The thermodynamic cycle of the pump is shown in FIG. 5B. Thermodynamic parameters at each state are presented in Table 2.

TABLE 2

| | State | | | | | | | |
|---|---|---|---|---|---|---|---|---|
| | 1 | 2' | 2 | 3 | 4 | 5' | 5" | 6 |
| T(K) | 258 | 282 | 273 | 336 | 308 | 272 | 272 | 256 |
| p(MPa) | 0.448 | 0.76 | 0.76 | 2.32 | 2.32 | 0.76 | 0.76 | 0.448 |
| ρ(kJ/kg) | 17.054 | 27.256 | 28.821 | 77.536 | 1008.5 | 102.71 | 94.032 | 159.87 |
| h(kJ/kg) | 417.08 | 431.46 | 422.37 | 460.85 | 256.77 | 256.77 | 262.76 | 197.7 |
| S(kJ/kg × K) | 1.841 | 1.852 | 1.819 | 1.842 | 1.191 | 1.209 | 1.231 | 0.995 |
| ξ | 1 | 1 | 1 | 1 | 0 | 0.265 | 0.292 | 0.094 |

where $Q_{out}$ is heat output, $W_{C1}$ and $W_{C2}$ are the work performed by the low pressure stage and high pressure stage compressors, $h_n$ is the enthalpy for the $n^{th}$ state, and ξ is the refrigerant quality defined as the ratio of the mass of vapor to the working fluid (refrigerant) to the total mass of the working fluid.

In this configuration, the intercooler regulates cycle operation such that thermodynamic state 2 remains unchanged and the operational point of the high pressure stage compressor 1*b* is independent from changes in the ambient temperature. The system exhibits no degradation of the installed capacity since states 3 and 4 remain unchanged. The system also gains in efficiency over a simple vapor injection scheme due to a shift in refrigerant quality from 0.265 at state 5' to 0.343 at state 5". This shift decreases the mass fraction of refrigerant reaching the evaporator 2, reducing the mechanical work required from the lower stage compressor 1*a*. Intercooling from state 2' to 2 further increases the overall cycle efficiency by reducing the amount of work needed to compress the refrigerant in the high pressure stage. In this process, the refrigerant is superheated less, reducing the refrigerant temperature and density gradients over the condenser and improving the overall condenser heat transfer efficiency.

Example

Operation at Intermediate Ambient (Cold Source) Temperatures

When operating at an intermediate temperature, e.g. 260K, the refrigerant routing valves 45 direct the refrigerant through the flash-tank circuit. The high pressure stage compressor 1*b* and electronic expansion valve 3*a* are operated to maintain a The coefficient of performance for the system at an ambient temperature of 260K is:

$$COP=Q_{out}/(W_{C1}+W_{C2})=4.19.$$

The same type of analysis performed for a temperature of −13° F. shows the first-stage compressor 1*a* can be operated at slightly lower output, and the thermal expansion valve 3*b* can be set so as to achieve a compression ratio of 2.81:1 for lower cycle operating pressures of 0.76 MPa (intermediate pressure) and 0.27 MPa (low side pressure—evaporator). With these settings, the temperature difference between the evaporator and cold source remains unchanged and the system achieves an overall coefficient of performance of 3.36. Table 3 summarizes an efficiency analysis for a range of cold source temperatures at constant refrigerant mass flow rate, including the operational parameters of evaporator pressure $P_{EVP}$, compression ratios for the low and high stage compressors $CR_{C1}$ and $CR_{C2}$, work performed by the low and high stage compressors $W_{C1}$ and $W_{C2}$, and the and calculated COP.

TABLE 3

| $T_c$ (K) | $P_{EVP}$ (MPa) | $CR_{C1}$ | $CR_{C2}$ | $W_{C1}$(kJ/kg) | $W_{C2}$(kJ/kg) | COP |
|---|---|---|---|---|---|---|
| 245 | 0.24 | 3.16:1 | 3.05:1 | 26.10 | 38.48 | 3.16 |
| 248 | 0.27 | 2.81:1 | 3.05:1 | 22.26 | 38.48 | 3.36 |
| 260 | 0.45 | 1.70:1 | 3.05:1 | 10.20 | 38.48 | 4.19 |
| 265 | 0.46 | 1.65:1 | 3.05:1 | 6.47 | 38.48 | 4.54 |
| 276 | 0.76 | — | 3.05:1 | — | 38.48 | 5.30 |
| 281 | 0.84 | — | 2.76:1 | — | 36.18 | 5.64 |
| 285 | 0.92 | — | 2.52:1 | — | 34.47 | 5.92 |

The efficiency advantages introduced by the regenerated, inter-stage vapor recirculation system include near nominal/optimal operation for the upper stage compressor 1*b* and enhancement of the overall cycle efficiency by recycling the refrigerant heat post lower stage compression. The off-optimal variability in the cycle compression duty is shifted to the low pressure stage, since the heat produced by the lower stage compressor 1*a* can be reused via the intercooler. The inverter driven low pressure stage compressor 1*a* may be required, depending on the outdoor ambient temperature to operate at off-optimal conditions in either stage 1 or stage 2 due to either the reduction in the necessary compression ratio or a reduction in the mass fraction of refrigerant reaching the evaporator coils, as determined by the inter-stage vapor recirculation mechanism. As a result, compressor efficiency may be lower and the temperature of the refrigerant at compressor outlet (state 2') may higher. The intercooler/regenerator reduces refrigerant temperature at the inlet of compressor 1*b* by transferring this heat to the refrigerant entering the flash-tank 5. In the process, the quality of the refrigerant is increased (5'→5") and the total amount of refrigerant continuing to the thermal expansion valve 3*b* and evaporator 43 is reduced, thus readjusting the work input required by compressor 1*a*. For cold source temperatures below 260K, when the low pressure extender cycle is in use, the intercooler and inter-stage vapor recirculation increase efficiency on average by 12% versus a regular cycle heat pump operating between the same pressures and evaporator exit temperatures.

Figure 6:
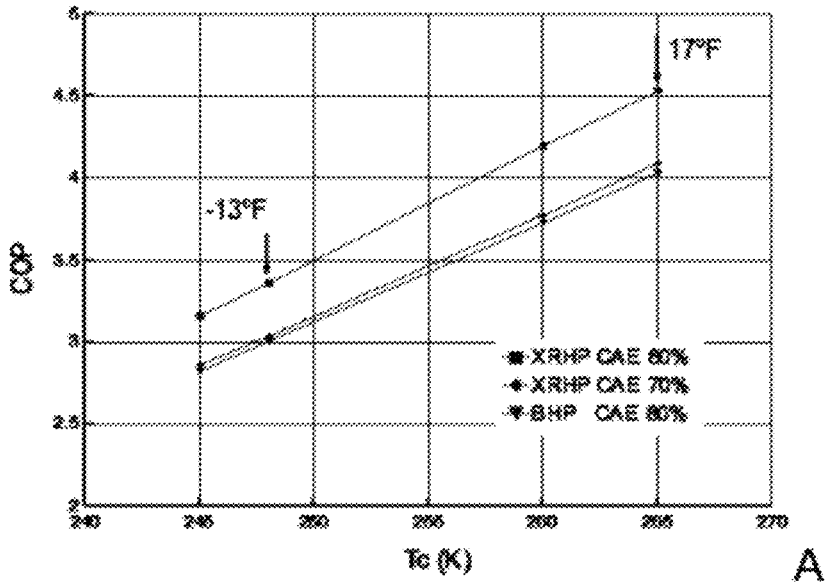
FIGS. 6A and B show comparisons of coefficients of performance (COP) as a function of ambient (cold source) temperature for an extended range heat pump under various operating conditions and a conventional heat pump system.
Figure 6:
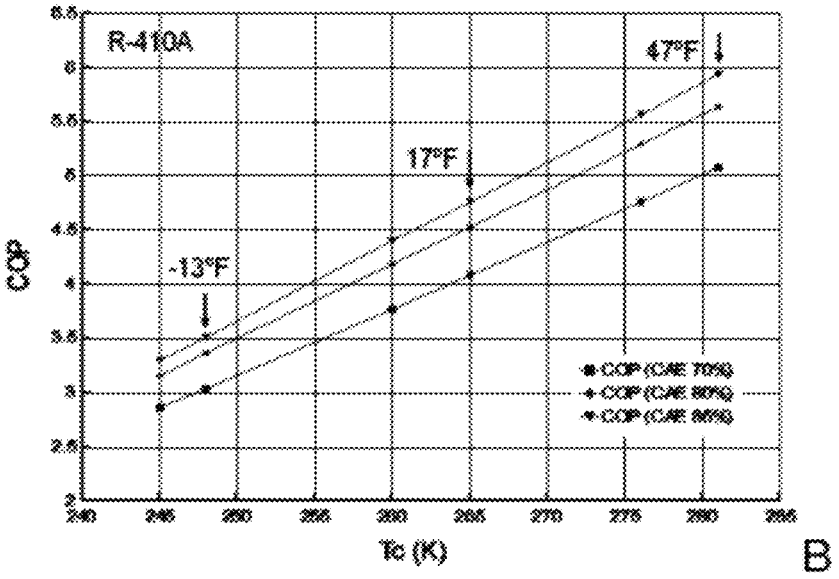

FIG. 6A shows that the present system fitted with compressors operating at 70% adiabatic efficiency (CAE) is more efficient at low temperatures than a conventional heat pump (BHP) equipped with 80% CAE compressors operating between the same pressures and condenser/evaporator exit temperatures. At higher temperatures, the lower stage of the XRHP may be off, with valves 47, 48 of the extra evaporator coils 43*b,c* closed, and the routing valves 45 redirecting the refrigerant to bypass the flash-tank 5 via bypass lines 50 and 51. FIG. 6B shows the performance of the system as a function of ambient temperature with compressor CAEs of 85%, 80% and 70%. It is unlikely that both compressors will operate off optimal since compressor 1*b* always operates with the refrigerant mass flow at or near nominal. Heat output is delivered at capacity since the mass flow rate of refrigerant is nearly constant at all compression ratios. Compressor discharge temperature is maintained at manageable levels by splitting the total compression ratio between two compressors and by intercooling. The gain in COP is uniform over the entire low range of ambient temperatures. The heat capacity is nearly constant over the entire cold source temperature range due to the particular design of the evaporator 43. Unexpected flooding observed in existing single compressor FTVI cycles is not an issue with the present invention, where the streams are mixed prior to entering the second compression stage.

Figure 7:
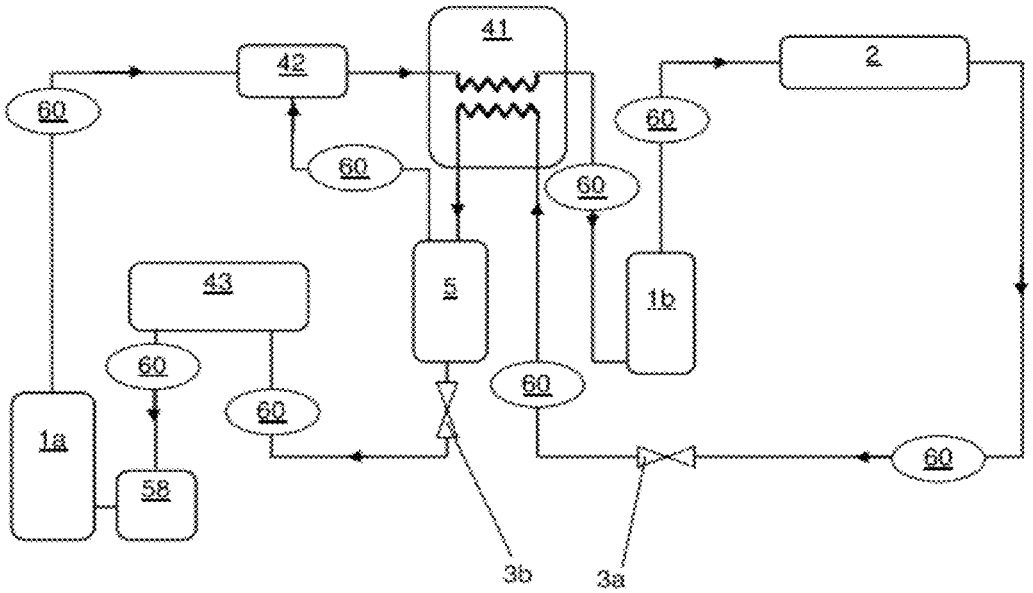
FIG. 7 is a diagram showing a second embodiment of an extended range heat pump according to the present invention.

FIG. 7 shows one exemplary embodiment of an extended range heat pump comprising an accumulator 58, a condenser 2, a high pressure stage compressor 1*b*, an evaporator 43, a thermal expansion valve 3*b*, a lower pressure stage compressor 1*a*, a check valve 44, an electronic expansion valve 3*a*, a flash tank 5, an intercooler/heat exchanger 41, and a mixing manifold 42. Arrows indicate the direction of working gas/fluid flow. The evaporator 43 may have any number n of evaporator coils 43*a-n*, depending on the degree to which working gas volume is to be controlled. The system may also be configured to comprise a plurality of evaporators arranged in parallel rather than a single evaporator with multiple and independently valved evaporator coils. The positions of the check valves 44 shown in the figures are exemplary and the number and locations of check valves may be varied. The systems shown in the figures may additionally and optionally comprise sensors 60, such as mass flow meters, thermocouples and/or pressure transducers at various locations to monitor flows, temperatures, and/or pressures in the system. The sensors may be electrically or wirelessly coupled to a microprocessor configured for controlling system components, including the operational parameters of the first and second compressors, regulation of expansion valves, and opening and closing of evaporator coil valves and/or routing valves (bypass valves).

Reference to particular embodiments of the present invention have been made for the purpose of describing the extended range heat pump and methods for operating and extended range heat pump. It is not intended that such references be construed as limitations upon the scope of this invention except as set forth in the appended claims.

REFERENCES

Bertsch, S. S., Groll, E. A. (2008) Int. J. of Refrigeration 31:1282-1292.

Heo, J., Jeong, M. W., and Kim, Y. (2010a) Int. J. of Refrigeration 33:848-855

Heo, J., Jeong, M. W., Baek, C., and Kim, Y. (2010b) Int. J. of Refrigeration 34(2):444-453.

Kim, B. H. (2001) Korean Journal of Air-Conditioning and Refrigeration 13:746-756.

Wang, X., Hwang, Y., and Radermacher, R. (2009) Int. J. of Refrigeration 32:1442-1451.

The above references are incorporated herein by reference in their entirety:

The invention claimed is:

1. A two-stage extended range heat pump system comprising a first section and a second section forming a heat pump circuit wherein:

the first section comprises, an intercooler, a flash tank, a first expansion valve, an evaporator, a first compressor, and a mixing manifold in sequential fluid communication;

the second section comprises the intercooler, a second compressor, a condenser, and a second expansion valve in sequential fluid communication; and wherein the intercooler is located between the second expansion valve and the flash tank.

2. The heat pump system of claim 1, wherein the evaporator comprises multiple evaporation coils and inflow and outflow valves that independently control a flow of an incoming working fluid through the evaporator coils.

3. The heat pump system of claim 1, wherein the first section comprises a plurality of evaporators arranged in parallel with respect to a flow of a working fluid.

4. The heat pump system of claim 1, wherein the system is configured such that the intercooler heats a working fluid moving from the second expansion valve to the flash tank, and cools a working fluid moving from the mixing manifold to the second compressor.

5. The heat pump system of claim 4, and further comprising sensors configured for measuring the flow, temperature, and/or pressure of a working fluid and a microprocessor electronically or wirelessly connected to the sensors and configured to control operation of the heat pump system.

6. The heat pump system of claim 5, wherein a volume available for expansion of the working fluid in the evaporator is decreased when an ambient temperature surrounding the evaporator exceeds a specified value.

7. The heat pump system of claim 5, and further comprising:

a first routing valve in the first section, said first routing valve being located between the evaporator and the first compressor;

a second routing valve in the second section, said second routing valve located between the second expansion valve and the intercooler;

a first bypass line configured to convey a working fluid from the first routing valve to the second compressor without passing through the first compressor or the intercooler; and a second bypass line configured to convey a working fluid from the second routing valve to the evaporator without passing through the intercooler or the flash tank.

8. The heat pump system of claim 7, wherein the first and second routing valves are configured such that the working fluid bypasses the first compressor and the flash tank when an ambient temperature surrounding the evaporator exceeds a specified value.

9. A method for operating a two-stage heat pump comprising a first compressor, a second compressor, a condenser, an evaporator, a flash tank, a first expansion valve, and a second expansion valve, said method comprising:

compressing a refrigerant gas in two stages with the first compressor and the second compressor;

cooling the refrigerant gas between the first and second compressors;

conveying the refrigerant gas from the second compressor to a condenser;

conveying a mixture of refrigerant gas and refrigerant liquid from the condenser through the first expansion valve and into the flash tank;

separating refrigerant gas from refrigerant liquid in the flash tank;

conveying refrigerant gas from the flash tank to a mixing means and mixing the refrigerant gas from the flash tank with a flow of refrigerant gas from the first compressor to the second compressor;

conveying refrigerant liquid from the flash tank through the second expansion valve to the evaporator; and conveying refrigerant gas from the evaporator to the first compressor.

10. The method of claim 9, wherein the mixing of refrigerant gas from the flash tank with a flow of refrigerant gas from the first compressor takes place before cooling the refrigerant gas between the first and second compressors.

11. The method of claim 10, wherein the refrigerant gas from the flash tank has a higher temperature than the refrigerant gas from the first compressor.

12. The method of claim 11, wherein cooling the refrigerant gas between the first and second compressors is accomplished by means of an intercooler that transfers heat from the compressed refrigerant gas to the mixture of refrigerant gas and refrigerant liquid from the condenser before the mixture reaches the flash tank.

13. The method of claim 9, and further comprising changing a volume available for expansion of the refrigerant liquid in the evaporator depending on an ambient temperature surrounding the evaporator.

* * * * *